US005808458A

United States Patent [19]

Fujisawa et al.

[11] Patent Number: 5,808,458

[45] Date of Patent: Sep. 15, 1998

[54] REGULATED POWER SUPPLY CIRCUIT

[75] Inventors: Masanori Fujisawa; Sachito Horiuchi; Kengo Adachi, all of Kyoto, Japan

[73] Assignee: Rohm Co., Ltd., Kyoto, Japan

[21] Appl. No.: 942,609

[22] Filed: Oct. 2, 1997

[30] Foreign Application Priority Data

Oct. 4, 1996 [JP] Japan ..... 8-283043

[51] Int. Cl.[6] ..... G05F 3/16

[52] U.S. Cl. ..... 323/312; 323/315

[58] Field of Search ..... 323/312, 313, 323/314, 315, 316

[56] References Cited

U.S. PATENT DOCUMENTS 3,573,595 4/1971 Galluppi ..... 323/312
4,292,584 9/1981 Kusakabe ..... 323/316
4,506,208 3/1985 Nagano ..... 323/314
5,410,241 4/1995 Cecil ..... 323/315

*Primary Examiner*—Peter S. Wong
*Assistant Examiner*—Y. J. Han
*Attorney, Agent, or Firm*—Fay, Sharpe, Beall, Fagan, Minnich & McKee

[57] ABSTRACT

In a regulated power supply circuit which includes a differential amplifier circuit and a current output circuit which receives the output from the differential amplifier circuit, wherein the current output circuit comprises a drive stage transistor which operates upon receipt of an output from the differential amplifier circuit at an input terminal thereof, a current output stage of a MOSFET which is driven by the drive stage transistor and a load resistor for the drive stage transistor connected to the output side thereof, and the load resistor and the drive stage transistor are provided between a power source line and a ground line and the MOSFET is driven by an output taken out via the load resistor.

8 Claims, 3 Drawing Sheets

REGULATED POWER SUPPLY CIRCUIT

BACKGROUND OF THE INVENTION

1. Field of the Invention

The present invention relates to a regulated power supply circuit and, more specifically, to a constant current type regulated power supply circuit having an output transistor of a MOSFET (herein below simply called as an FET) driven with a low voltage which includes an output stage EFT, can generates efficiently a large output current even with a low voltage power source and permits to make use of a large dynamic range for the regulation.

2. Background Art

As a conventional regulated power supply circuit formed in an IC and making use of an FET as the output thereof, a power source voltage regulation circuit as illustrated in FIG. 3 is exemplified which is constituted by a differential amplifier circuit 10 in a CMOS structure and a current output circuit (a current booster circuit) 11 formed by an FET.

In this circuit, numeral 12 is an output terminal at which a constant voltage is provided and numeral 13 is a power source generating a reference voltage Vr which is applied to one input of the differential amplifier circuit 10. The differential amplifier circuit 10 includes inside thereof a differential amplifier 10*a* and a constant current source 10*b* having a current value of I. Further, in this circuit, as a load for the current booster circuit 11 a series circuit of resistors R1 and R2 is inserted between the output terminal 12 and the ground GND.

Herein, the differential amplifier 10*a* includes a pair of N channel FETs Q10 and Q11 which perform a differential operation and P channel FETs Q12 and Q13 in a current mirror connection which are provided between drains of the respective N channel FETs Q10 and Q11 and a power source line VDD as an active load. To the gate of the FET Q11 the reference voltage Vr is applied. Further, the both source sides of the FETs Q10 and Q11 are connected in common and are grounded via an FET Q14 serving as the constant current source 10*b*, and the FET Q14 is connected to a bias voltage line Vs at which a predetermined constant voltage is provided.

The gate of the FET Q10 is connected to a junction point N of the resistors R1 and R2 and receives a fed back voltage from the output side of the current booster circuit 11. Further, the drain side of the FET Q13 is connected to the gate of a P channel FET Q15 in a current output stage to drive the same, and the drain of the FET Q15 is connected to the output terminal 12.

In this circuit, the voltage at a terminal (the junction point) of the resistor R2 is fed back to the gate of the FET Q10 in the differential amplifier circuit 10, the differential amplifier circuit 10 operates so as to equalize the terminal voltage appearing at the resistor R2 with the reference voltage Vr and to generate a regulated constant voltage Vo at the output terminal 12.

The constant voltage Vo is expressed as follows;

$$Vo=(r1+r2)\cdot Vr/r2$$

wherein r1 is a resistance of the resistor R1 and r2 is a resistance of the resistor R2r and further the resistance r1 can be zero.

Because of the use of the CMOS circuit, the above explained regulated power supply circuit has an advantage that the operating current thereof can be limited, however, if not the voltage of the power source is more than 5V, it is impossible to generate a sufficient drive voltage for the FET Q15 in the current booster circuit 11. For this reason, if the power source voltage is lowered, an internal impedance of the FET Q15 increases. Accordingly, a large current can not be obtained and a poor efficiency of the circuit is resulted. In addition, a large dynamic range for the regulation can not be obtained.

FIG. 4 is a graph for explaining such a relationship and illustrating a characteristic on output current ID of the output stage FET Q15. In case when the power source voltage VDD is 5V or more, a voltage VDS (a voltage between the drain and source thereof) can be brought near to 5V, and a voltage VGS (a voltage between the gate and source thereof) upto about 3V can be used, therefore, as illustrated in characteristic A a regulation for the output voltage with respect to the output current ID can be effected in a range of substantially the inclined portion prior to assuming a constant output current ID. However, in case when the power source voltage VDD is about 3V, the voltage VDS (the voltage between the drain and source thereof) drops to about 2.5V or below and an obtainable voltage VGS (a voltage between the gate and source thereof) is at most about 2V. For this reason, the range where the regulation of the output voltage with respect to the output current ID can be effected is restricted to a range encircled by a dotted line among the inclined portion in the characteristic B. Because of such drop of the output voltage VGS a regulation of the output voltage in a position where the output current ID comes near to the upper limit of the inclined portion was conventionally impossible. Moreover, because of the drop in the voltage VGS, the characteristic of the inclined portion is lowered (an angle formed between the inclined portion and the abscissa axis of voltage VDS is decreased) and the increase rate in voltage VDS with respect to output current ID increases to further deteriorate the efficiency of the circuit.

For this reason, in a regulated power supply circuit which is driven with a low voltage power source having about 3V or less, a bipolar transistor rather than an FET is used for the output stage transistor, because of the lower driving voltage for the bipolar transistor. Further, the differential amplifier circuit and the current booster circuit are frequently constituted by bipolar transistors. However, if a large output current is required for this type of regulated power supply circuit using the bipolar transistors, an operating current with respect to the output current increases and a problem that the efficiency of the circuit is also decreased in the same manner as in the use of the FETs.

SUMMARY OF THE INVENTION

An object of the present invention is to resolve the above conventional problems and to provide a regulated power supply circuit having an FET at its output stage in which a comparatively large output current can be efficiently generated under a low voltage and a large dynamic range for the regulation can be obtained.

The structure of the regulated power supply circuit of the present invention for achieving the above objects which includes a differential amplifier circuit and a current output circuit which receives the output from the differential amplifier circuit, amplifies the current thereof and outputs the same, and in which at an output terminal of the current output circuit where a load is connected, a resistor circuit is provided in parallel with the load, a part or entirety of the voltage outputted to the load is fed back to one input terminal of the differential amplifier circuit via the resistor circuit, and a constant voltage is applied to the other terminal of the differential amplifier circuit to flow a constant current through the resistor circuit thereby the output voltage to the load is stabilized to be constant, wherein the current output circuit comprises a drive stage transistor which operates upon receipt of an output from the differential amplifier circuit at an input terminal thereof, a current output stage of a MOSFET which is driven by the drive stage transistor and a load resistor for the drive stage transistor connected to the output side thereof, and the load resistor and the drive stage transistor are provided between a power source line and a ground line and the MOSFET is driven by an output taken out via the load resistor.

Namely, the current output circuit is constituted in such a manner that the output of the differential amplifier circuit is received by the drive stage transistor and the MOSFET is driven by the drive stage transistor via the load resistor, and further, a series circuit of the load resistor and the drive stage transistor is arranged between the power source line and the ground line. Thereby, the gate of the output stage FET can be driven with a voltage covering a range substantially from the power source voltage potential near to the ground potential.

As a result, for example even in a case of a low voltage power source of about 3V, the voltage VGS (the voltage between the gate and source thereof) can be brought to a value near to the power source voltage. Therefore, even in case of a lower power source voltage, the characteristic of the inclined portion prior to moving into a constant current of the output current ID as illustrated in FIG. 4 is raised and the angle of the inclined portion with respect to the abscissa axis of voltage VDS increases. Moreover, since the FET can be driven upto the region where the internal impedance thereof is low, the dynamic range exceeds the encircled dotted range and expands near to the power source voltage, thereby a large dynamic range can be obtained. Further, even when a large output current is flowed, a power consumption waste can be reduced.

DESCRIPTION OF THE PREFERRED EMBODIMENTS

Figure 1:
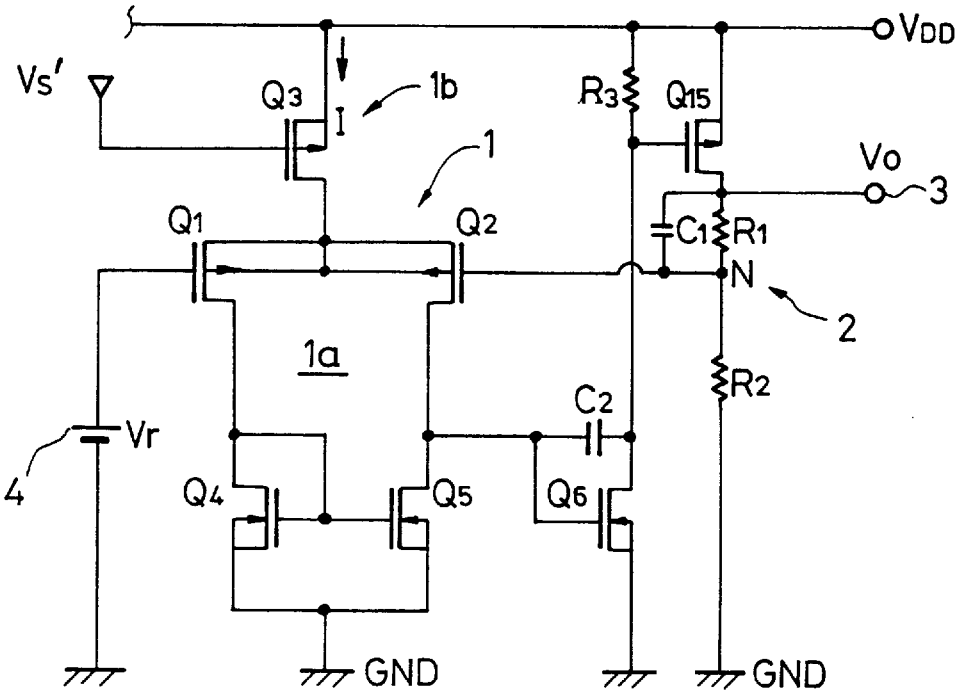
FIG. 1 is a block diagram of one embodiment of a regulated power supply circuit to which the present invention is applied.
Figure 3:
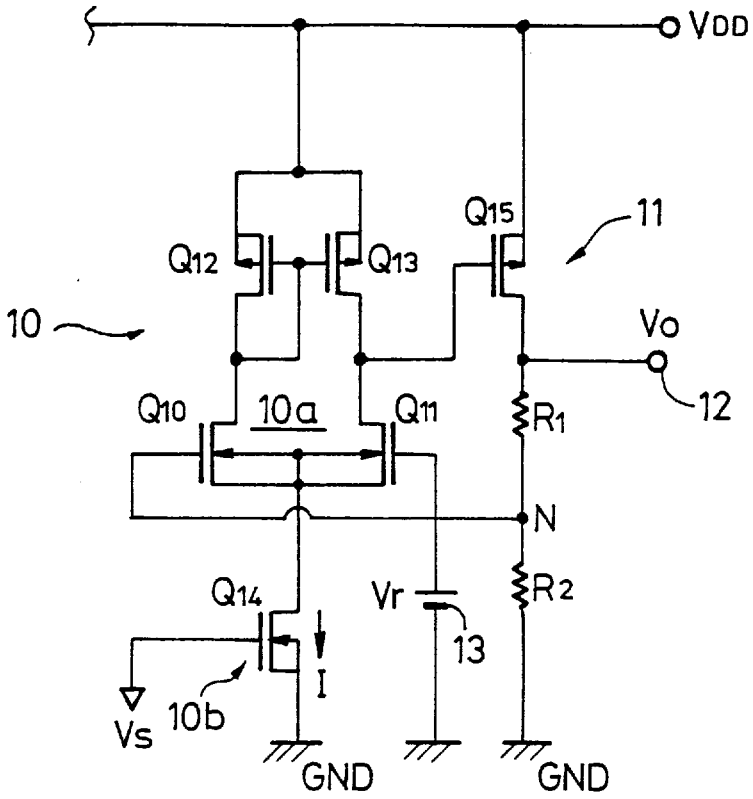
FIG.3 PRIOR ART
FIG. 3 is a block diagram of a conventional CMOS type regulated power supply circuit.

Contrary to the current booster circuit 11 in FIG. 3, in a current booster circuit (a current output circuit) 2 in FIG. 1 an N channel FET Q6 which drives the output stage transistor Q15 is provided as a prior stage, and the FET Q6 is designed to receive the output from the differential amplifier circuit 1 and to drive the output stage transistor Q15 via a load resistor R3 for the FET Q6. Herein, the elements in FIG. 1 same or equivalent as the elements in FIG. 3 are designated by the same reference symbols and the explanation thereof is omitted.

The differential amplifier circuit 1 in FIG. 1 corresponds to the differential amplifier circuit 10 in FIG. 3, however, is different in the following points, in that the constant current source is inserted at the side of the power source line VDD, and the load transistors in a current mirror connection are inserted at the side of the ground and from which the output signals are taken out, therefore, the relationship of the power source line and the ground line with respect to the differential amplifier circuit is exchanged in connection with that in FIG. 3. Correspondingly, the N channel FET in FIG. 3 is replaced by a P channel FET in FIG. 1 and the P channel FETs in the active load transistors in FIG. 3 are replaced by N channel FETs.

The drain of the FET Q6 is connected to the power source line VDD via the load resistor R3 for the transistor, the source thereof is grounded and the gate thereof is connected to the drain of an N channel FET Q5 in the differential amplifier circuit 1. Numeral 3 is an output terminal which provides a regulated constant voltage Vo and numeral 4 is a constant voltage power source which generates a reference voltage Vr to be applied to one input terminal of the differential amplifier circuit 1. Further, Vs' corresponds to Vs in FIG. 3 and represents a bias voltage line providing a predetermined constant voltage.

The differential amplifier circuit 1 includes inside therein a differential amplifier 1*a* and a constant current source 1*b* (having current value I). The differential amplifier 1*a* includes a pair of P channel FETs Q1 and Q2 which perform a differential operation, the sources of the respective transistors are connected in common and thereafter connected to the power source line VDD via the drain-source of a P channel FET Q3 constituting the constant current source 1*b*.

The both drains of the FETs Q1 and Q2 are respectively grounded via the N channel FETs Q4 and Q5 in a current mirror connection which are provided as an active load. To the gate of the transistor Q1 the reference voltage Vr is applied, and the gate of the transistor Q2 is connected to the junction point N of the resistors R1 and R2 and through the junction N a fed back voltage from the output side of the current booster circuit 2 is applied.

Further, between the output terminal 3 and the junction point N a capacitor C1 for canceling noises is provided and between the drain and gate of the FET Q6 a capacitor C2 for canceling noises is also provided.

In this circuit, since the source side of the FET Q6 is grounded and the drain side thereof is connected to the power source line VDD via the load resistor R3, the gate of the output stage transistor Q15 assumes substantially the ground potential, when the FET Q6 is completely rendered to an ON condition, and the gate assumes substantially the potential of the power source line VDD, when the FET Q6 is completely rendered to an OFF condition. Namely, the present circuit can drive the gate of the output stage transistor Q15 with a voltage covering the range from substantially the ground potential to the potential of the power source line VDD. Thereby, the FET Q6 assumes completely an ON condition, the output stage transistor Q15 is rendered to an ON condition and the internal impedance thereof is lowered. As a result, even when an output current is increased, a power loss is limited and even with a low voltage power source the efficiency reduction is greatly suppressed. Further, in case of a small output current, even if the output stage transistor Q15 is rendered to an OFF condition and the internal impedance thereof is increased, the power consumption is limited because of the small output current.

Figure 4:
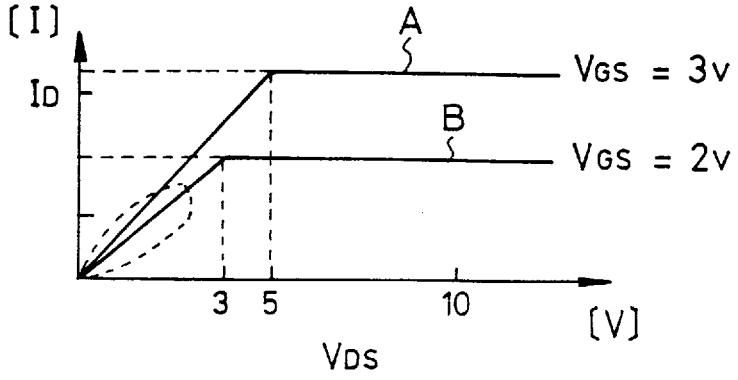
FIG. 4 is a diagram for explaining a relationship between output current and gate voltage of the conventional CMOS type regulated power supply circuit.

Since the voltage VGS can take a value near the power source voltage VDD as explained above, the inclined portion in the characteristic of output current ID illustrated in FIG. 4 rises, and the inclination angle increases which implies to permit a large current flow. Moreover, a range of regulation is expanded and a large dynamic range can be obtained.

Figure 2:
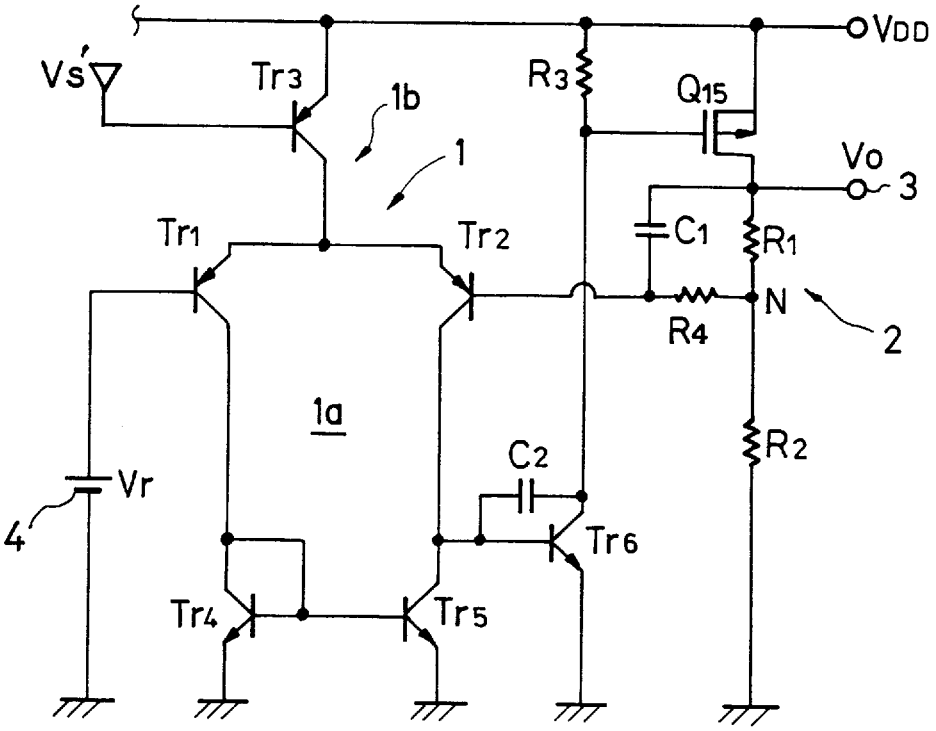
FIG. 2 is a block diagram of another embodiment to which the present invention is applied.

FIG. 2 shows another embodiment of a regulated power supply circuit in which the FETs Q1 through Q3 in the differential amplifier circuit 1 in FIG. 1 are replaced by PNP type bipolar transistors Tr1 through Tr3 and the FETs Q4 through Q6 in FIG. 1 are replaced by NPN type bipolar transistors Tr4 through Tr6. Namely, the P channel FETs Q1 and Q2 in FIG. 1 serving as the differential transistors are replaced by the NPN type bipolar transistors in FIG. 2 and between the junction point N and the base of the transistor Tr2 a protective resistor R4 is provided. However, the protective resistor R4 can be theoretically eliminated, and further if a bias setting is properly selected, NPN type bipolar transistors can be used for the differential transistors in FIG. 2 apart from the P channel FETs Q1 and Q2 in FIG. 1.

In the present circuit, the operation of the current source and differential amplifier circuit constituted by the PNP transistors Tr1 through Tr5 and the operation of the current booster circuit constituted by the drive stage transistor Tr6, the transistor Q15 and the load resistor R3 for the transistor Tr6 are substantially the same as those in FIG. 1. Therefore, the elements in FIG. 2 which are same or equivalent with those in FIG. 1 are designated by the same reference numerals or symbols, and the explanation thereof is omitted. In the regulated power supply circuit in FIG. 2, since the drive circuit for the output stage is constituted by bipolar transistors, the operation current thereof increases correspondingly. However, because the output stage is not constituted by a bipolar transistor, correspondingly the operation current is suppressed in comparison with a conventional output stage constituted by a bipolar transistor. Further, since the drive transistors for the output stage FET are bipolar transistors, correspondingly, the driving voltage, in that the voltage VGS in FIG. 4, is further raised to a value near the power source voltage VDD in comparison with the embodiment in FIG. 1, and still further, the driving voltage can also be lowered near the ground potential. Thereby, an increased component of the operating current is canceled out and the regulated power supply circuit of the present embodiment performs as a whole an efficient regulation operation like the embodiment in FIG. 1.

In the embodiments as explained above, the gate of the output stage FET is directly connected to the junction point between the load resistor R3 and the output terminal of the drive transistor to which the load resistor R3 operates as a load, however, such as a resistor can be inserted between the junction point and the gate. Further, a protective resistor can be inserted between the load resistor and the output terminal of the drive transistor.

We claim:

1. A regulated power supply circuit which includes a differential amplifier circuit and a current output circuit which receives the output from said differential amplifier circuit, amplifies the current thereof and outputs the same, and in which at an output terminal of said current output circuit where a load is connected, a resistor circuit is provided in parallel with said load, a part or entirety of the voltage outputted to said load is fed back to one input terminal of said differential amplifier circuit via said resistor circuit, and a constant voltage is applied to the other terminal of said differential amplifier circuit to flow a constant current through said resistor circuit thereby the output voltage to said load is stabilized to be constant, wherein said current output circuit comprises a drive stage transistor which operates upon receipt of an output from said differential amplifier circuit at an input terminal thereof, a current output stage of a MOSFET which is driven by said drive stage transistor and a load resistor for said drive stage transistor connected to the output side thereof, and the load resistor and said drive stage transistor are provided between a power source line and a ground line and said MOSFET is driven by an output taken out via said load resistor.

2. A regulated power supply circuit according to claim 1, wherein said drive stage transistor includes a input terminal and first and second terminals, and the first terminal as the output side of said drive stage transistor is connected to one terminal of said load resistor, the second terminal is connected to the ground line, the input terminal receives the output of said differential amplifier circuit, the other terminal of said load resistor is connected to the power source line and the gate of said MOSFET is connected to the one terminal of said load resistor.

3. A regulated power supply circuit according to claim 2, wherein said differential amplifier circuit includes a constant current source connected to the power source line, a pair of differential transistors which are disposed downstream said constant current source and perform a differential operation upon receipt of a current from said constant current source and an active load which is disposed downstream said differential transistors, and an output of said differential amplifier circuit is taken out from said active load.

4. A regulated power supply circuit according to claim 3, wherein said current output circuit is a current booster circuit, said drive stage transistor is an N channel MOSFET, said resistor circuit is a divider circuit formed by connecting a plurality of resistors in series and a voltage at a divided point of said divider circuit is inputted to the control electrode of one of said differential transistors to which the constant voltage is not inputted.

5. A regulated power supply circuit according to claim 4, wherein said current source is a P channel MOSFET, said differential transistors are P channel MOSFETs, said active load is N channel MOSFETs in a current mirror connection, and the respective source sides thereof are grounded.

6. A regulated power supply circuit according to claim 3, wherein said drive stage transistor is a bipolar transistor, said resistor circuit is a divider circuit formed by connecting a plurality of resistors in series, and a voltage at a divided point of said divider circuit is inputted to the control electrode of one of said differential transistors to which the constant voltage is not inputted.

7. A regulated power supply circuit according to claim 6, wherein said constant current source is a PNP type bipolar transistor, said differential transistors are PNP type bipolar transistors, said active load is NPN type bipolar transistors in a current mirror connection, and the respective emitter sides thereof are grounded.

8. A regulated power supply circuit according to claim 7, wherein said current output circuit is a current booster circuit and the voltage at the divided point is inputted to said control electrode via a resistor.

* * * * *